US005694776A

United States Patent [19]

Sahm

[11] Patent Number: 5,694,776

[45] Date of Patent: Dec. 9, 1997

[54] REFRIGERATION METHOD AND APPARATUS

[75] Inventor: Michael K. Sahm, Annandale, N.J.

[73] Assignee: The BOC Group, Inc., New Providence, N.J.

[21] Appl. No.: 594,100

[22] Filed: Jan. 30, 1996

[51] Int. Cl.[6] ..... F25D 13/06

[52] U.S. Cl. ..... 62/63; 62/332; 62/374; 62/381

[58] Field of Search ..... 62/63, 374, 332

[56] References Cited

U.S. PATENT DOCUMENTS

| | | | |
|---|---|---|---|
| 3,531,946 | 10/1970 | Hart . | |
| 3,805,538 | 4/1974 | Fritch, Jr. et al. . | |
| 4,233,817 | 11/1980 | Toth . | |
| 4,856,285 | 8/1989 | Acharya et al. | 62/374 |
| 4,858,445 | 8/1989 | Rasovich . | |
| 5,042,262 | 8/1991 | Fyger et al. . | |
| 5,170,631 | 12/1992 | Lang et al. . | |
| 5,220,803 | 6/1993 | Kiczek . | |
| 5,331,824 | 7/1994 | Miller et al. . | |

*Primary Examiner*—Ronald C. Capossela
*Attorney, Agent, or Firm*—David M. Rosenblum; Salvatore P. Pace

[57] ABSTRACT

A method and apparatus of refrigerating a heat load in which heat is indirectly exchanged between the heat load and a cryogenic refrigerant so that the heat load cools. Further heat is then indirectly exchanged between the heat load and the mechanical refrigerant. The mechanical refrigerant is subjected to refrigeration cycle in which the mechanical refrigerant is compressed, cooled, condensed, expanded and evaporated. Other heat is indirectly exchanged between the cryogenic refrigerant and the mechanical refrigerant. The cryogenic refrigerant is subjected to its heat exchange with the mechanical refrigerant after having exchanged heat with the heat load. The mechanical refrigerant is subjected to the indirect heat exchange with the cryogenic refrigerant between condensation and expansion of the mechanical refrigerant within the refrigeration cycle.

7 Claims, 1 Drawing Sheet

REFRIGERATION METHOD AND APPARATUS

BACKGROUND OF THE INVENTION

The present invention relates to a method and apparatus for refrigerating a heat load by cryogenic and mechanical refrigeration cycles. More particularly, the present invention relates to such a method and apparatus in which the cryogenic and mechanical refrigeration cycles are integrated. Even more particularly, the present invention relates to such a method and apparatus in which a cryogen after having engaged in indirect heat exchange with the heat load undergoes further heat exchange with a mechanical refrigerant, circulating within a mechanical refrigeration cycle.

Cryogenic and mechanical refrigeration cycles have been integrated in order to obtain the advantages of the respective types of refrigeration. For instance, in integrated cryogen and mechanical refrigeration cycles, cryogenic refrigeration is employed to obtain rapid crusting to enhance product quality and reduce moisture loss and mechanical refrigeration is employed to complete the fleecing process. For instance, in U.S. Pat. No. 5,220,803, an exhaust from a cryogenic immersion freezer is passed directly through a mechanical spiral freezer to provide up to 30 percent of the refrigeration capacity within the mechanical freezer. In U.S. Pat. No. 4,858,445, an exhaust of a cryogenic immersion freezer is used to provide indirect heat exchange with a circulating flow of heat exchange fluid through a mechanical runnel freezer. In U.S. Pat. No. 4,856,285, a cryogenic immersion freezer and a mechanical freezer are physically separated and indirect heat exchange is effected between the exhaust of cryogenic vapors from the immersion freezer to air circulating in the mechanical freezer environment. U.S. Pat. No. 3,805,538, U.S. Pat. No. 5,170,631 and U.S. Pat. No. 3,531,946 provide cryogenic spray zones in which a liquid cryogen is sprayed against articles to be crust frozen.

Cryogenic and mechanical freezers can also be integrated to provide peak shaving and auxiliary capacity to a mechanical refrigerator. For instance in U.S. Pat. No. 5,331,824, an auxiliary buffer volume is provided in which a cryogenic stream and a vapor discharge from an evaporator of a mechanical refrigeration produces refrigerant condensation. This results in an additional liquid phase mechanical refrigerant flow in a main refrigerant reservoir which feeds the evaporator. In U.S. Pat. No. 4,233,817, secondary chillers are used to provide auxiliary cooling capacity by providing additional refrigerant subcooling through indirect heat exchange with a cryogen. Subcooling is provided between a primary chiller liquid discharge and a cold space evaporator. In U.S. Pat. No. 5,042,262, a cascade approach is employed in which a $CO_2$ evaporator provides cooling in a freezer and a secondary cycle evaporator is used to cool the $CO_2$ cycle condenser. The foregoing patent allows for replacement of CFC/HCFC refrigerants with $CO_2$ and an incremental decrease in the cold space evaporator temperature.

A major problem with integrated cryogenic/mechanical refrigeration devices is that where cryogenic vapors or liquids are passed into a mechanical refrigeration environment, a non-respirable environment is produced within the mechanical refrigerator. Additionally, in all of the foregoing mentioned refrigeration patents, the cryogenic refrigerant is discharged from the process at very low temperatures. Thus, potential refrigeration due to temperature differential to the environment is not utilized.

As will be discussed, the present invention provides a refrigeration device in which cryogenic and mechanical refrigeration cycles are integrated in a manner in which cryogenic vapors are not introduced into a mechanical freezing environment. Furthermore, the present invention provides an integrated cryogenic mechanical refrigeration method and apparatus that is designed to allow the cryogenic refrigerant to be more fully utilized then in prior art integrated refrigeration cycles.

SUMMARY OF THE INVENTION

The present invention provides a method of refrigerating a heat load. In accordance with a step a) of the method, heat is indirectly exchanged between the heat load and a cryogenic refrigerant so that the heat load cools. In a step b), further heat is indirectly exchanged between the heat load and the mechanical refrigerant. In a step c), the mechanical refrigerant is subjected to a refrigeration cycle in which the mechanical refrigerant is compressed, cooled, condensed, expanded, and evaporated. In a step d), other heat is indirectly exchanged between the cryogenic refrigerant and the mechanical refrigerant. The cryogenic refrigerant is subjected to step d) after the indirect heat exchange of step a) and the mechanical refrigerant is subjected to step d) between the condensation and expansion of step c).

In another aspect, the present invention provides a refrigeration apparatus comprising a cryogenic heat exchanger for exchanging heat between a cryogenic refrigerant and a heat load. A mechanical refrigeration circuit is provided having at least a compressor for compressing a mechanical refrigerant, a condenser for condensing the mechanical refrigerant, a valve for expanding and cooling the mechanical refrigerant, and an evaporator for exchanging further heat between the heat load and the mechanical refrigerant. As can be appreciated, the term "at least" is used herein and in the claims because the present invention has application to more complex mechanical refrigeration circuits which at minimum have a compressor, condenser and etc. In the present invention, the cryogenic heat exchanger and the evaporator are arranged such that the heat is exchanged between the cryogenic refrigerant and the heat load before the further heat is exchanged between the heat load and the mechanical refrigerant. A heat exchanger linking the cryogenic heat exchanger and the mechanical refrigeration circuit is provided so that other heat is exchanged between the mechanical refrigerant and the cryogenic refrigerant after the cryogenic refrigerant has exchanged heat with the heat load.

In a method and apparatus in accordance with the present invention, since the heat exchange between cryogenic refrigerant and the heat load is indirect there is no evolution of vapors that could produce non-respirable atmospheres within the refrigeration environment. In addition to the foregoing, since the cryogenic refrigerant is engaging in heat exchange with the mechanical refrigerant after the mechanical refrigerant has been condensed but before the mechanical refrigerant has been expanded, such heat exchange is occurring at the highest temperature possible with respect to integrated mechanical and cryogenic refrigeration circuits. As a result, the cryogenic refrigerant is ejected from the process at a higher temperature than that obtainable in prior art integrations and thus, the refrigeration capacity of the cryogenic refrigerant is utilized to a greater extent than that of prior art integrations. It is to be noted that as used herein and in the claims, the term "cryogen" means a liquefied atmospheric gas such as liquid nitrogen, or other liquefied gas such as carbon dioxide not existing as a liquid under normal atmospheric environmental conditions.

BRIEF DESCRIPTION OF THE DRAWINGS

While the specification concludes with claims distinctly pointing at the subject matter that applicant regards as his invention, it is believed that the invention will be better understood when taken in connection with the accompanying drawings in which:

DETAILED DESCRIPTION

Figure 1:
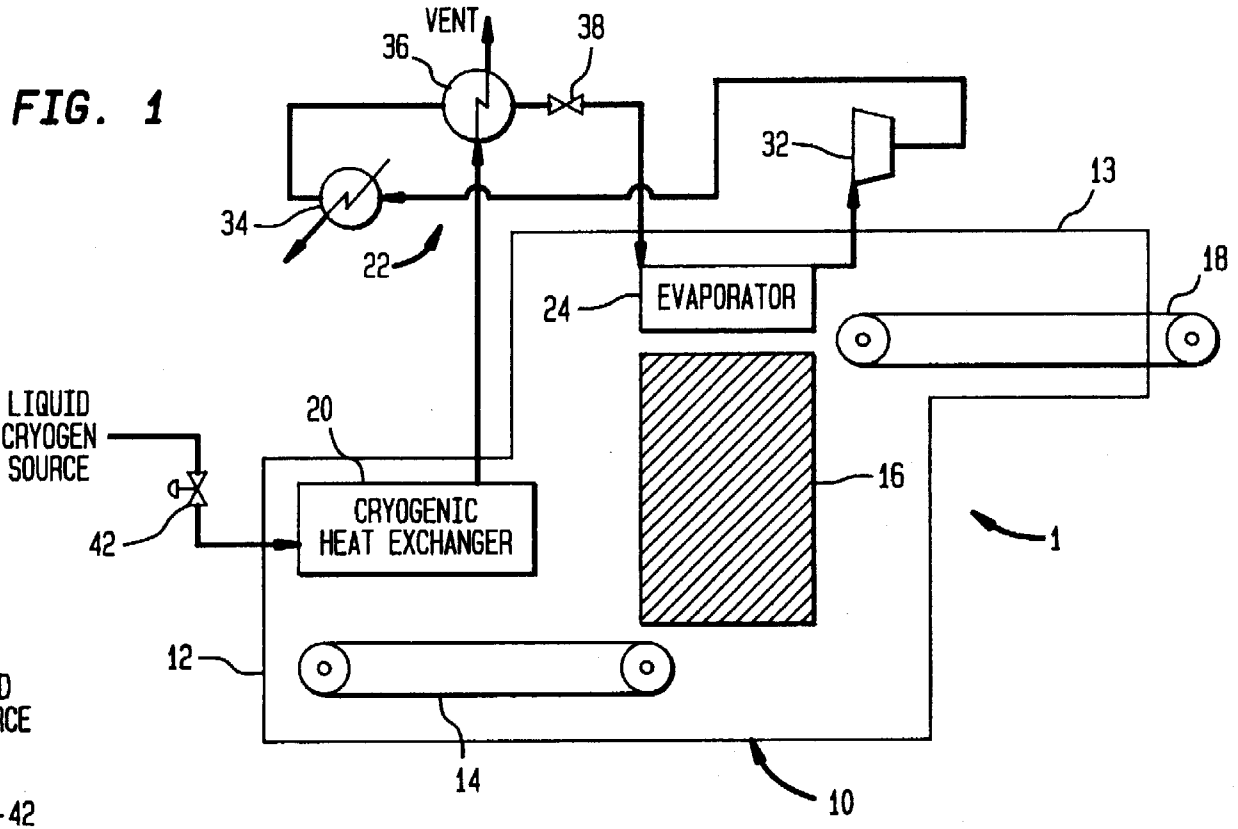
FIG. 1 is a schematic view of a refrigeration apparatus for carrying out a method in accordance with the present invention.

With reference to FIG. 1, a refrigeration apparatus 1 for carrying out a method in accordance with the present invention as illustrated. Refrigeration apparatus 1, for purposes of explanation, is illustrated as a spiral refrigerator having a refrigeration cabinet 10. Refrigeration cabinet 10 has an inlet vestibule 12 and an outlet vestibule 13. Articles are conveyed into refrigeration apparatus 10 by way of an inlet conveyor 14 located within inlet vestibule 10. Product is transported from inlet conveyor 14 to spiral belt mechanism 16 and then to outlet conveyor 18 on which food is conducted through outlet vestibule 13 and out of refrigeration cabinet 10.

As could be appreciated by those skilled in the art, a refrigeration apparatus in accordance with the present invention, in case of a spiral freezer, could employ a single belt running between the inlet and outlet thereof, the belt having been conducted within the spiral carousel. Also, in any refrigeration apparatus, the cabinet could be simplified over the illustrated embodiment through deletion of inlet and outlet vestibules 12 and 13.

During operation of refrigeration apparatus 1, heat is indirectly exchanged between the articles, which act as a heat load, and a cryogenic refrigerant by means of a cryogenic heat exchanger 20 located within inlet vestibule 12. Such heat exchanges causes a frozen crust to form on the food. Further heat is then exchanged between the food and a mechanical refrigerant circulating within a mechanical refrigeration circuit 22. Such further heat exchange takes place by provision of an evaporation unit 24 located within freezing cabinet 10. Evaporation unit 24 is positioned so that final freezing takes place within the product as it is conducted by spiral belt mechanism 16. Although not shown, fans and like auxiliary devices are generally provided to circulate cold air through evaporation unit 24 and through spiral belt mechanism 16.

Figure 2:
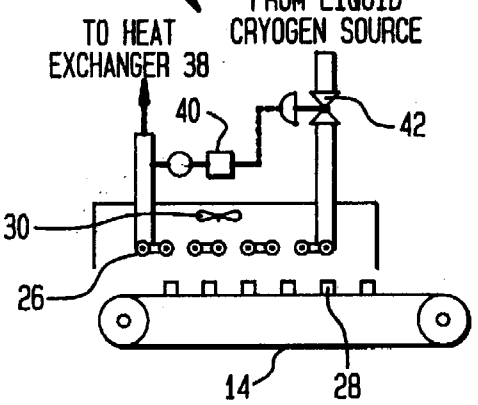
FIG. 2 is a schematic view of a cryogenic heat exchanger in accordance with the present invention.

With additional reference to FIG. 2, heat exchanger 20 can be fabricated of serpentine turns of bare metal tubing 26 to function as cryogenic heat exchange elements. Within tubing 26, liquid cryogen is vaporized and heated to a superheated vapor. Ice and snow formation on the outside of tubing 26 can be minimized by fabricating tubing 26 from bare metal as opposed to fined surfaces. Indirect convective heat exchange between the cryogen and product 28 (acting as the heat load) can be provided by a circulating fan 30 which blows air against through? tubing 26 and then product 28. Another aspect of the illustrated embodiment is that cryogen flows in a direction opposite or countercurrent to that of product 28. This causes a countercurrent type of temperature profile to achieve best heat exchange.

Mechanical refrigeration circuit 22 in addition to evaporation unit 24 utilizes a compressor 32 to compress the refrigerant. Thereafter, the refrigerant is cooled within a condenser 34. After the cooling, the mechanical refrigeration is then subcooled within a heat exchanger 36 linked to cryogenic heat exchanger 20 so that heat is exchanged between the mechanical refrigerant and the cryogenic refrigerant after the cryogenic refrigerant has thereby exchanged heat with the heat load. The refrigerant is then expanded within the expansion valve 38 and introduced into evaporation unit 24.

As can be appreciated, the temperature of cryogen discharged from tubing 26 must be controlled so that it does not freeze the mechanical refrigerant as it flows through heat exchanger 36. Such control can be effected by use of a temperature sensor 40 and a feed back control loop to control a proportional valve 42. Proportional valve 42 controls the flow rate of liquid cryogen so that the temperature of the cryogen as sensed by temperature sensor 40 does not fall below a temperature selected not to freeze the mechanical refrigerant within heat exchanger 36. Refrigeration apparatus 1 could be designed to function at a steady state and in response to a constant heat load. In such case the aforementioned temperature feed back control loop might not be utilized and a fixed size orifice or other device used to control the cryogen flow rate and hence control temperature 40.

By way of example, liquid nitrogen can serve as the cryogenic refrigerant. In such example, liquid nitrogen having a temperature of −186° C. and a pressure of about 275 kPa is drawn at a flow rate of 458 $nm^3/hr$ into cryogenic heat exchanger 20. After heat exchange within cryogenic heat exchanger 20, the liquid nitrogen increases temperature to about −50° C. at control point 40. This heated flow of nitrogen then enters heat exchanger 36 where it exchanges heat with the mechanical refrigerant and is thereafter vented at a temperature of between 30° and 43° C. The mechanical refrigerant which can be R22 refrigerant is discharged from the evaporation unit 24 as a vapor having a temperature of about −32° C., a pressure of about 155 kPa and a flow rate of 984 $m^3/hr$. Thereafter, such vapor is compressed by compressor 32 to produce a high pressure gas having a temperature of about 126° C. and a pressure of about 1670 kPa. Condenser 34 condenses the gas into a high pressure liquid having a temperature of about −43° C. and a pressure of about 1670 kPa. After passage through heat exchanger 36, the mechanical refrigerant has a temperature of about 34° C. and a pressure of about 1670 kPa. Such liquid is then expanded within expansion valve 38 to produce a low pressure two phase fluid having a vapor fraction of about 34 percent, a temperature of about −32° C. the pressure of about 155 kPa.

In the illustrated embodiment, heat exchange with the heat load takes place within cryogenic heat exchanger 20 in order to crust the product. The present invention is not, however limited to such embodiment. For instance, cryogenic heat exchanger and evaporator could be situated near one another with the cryogenic heat exchanger being used for peak shaving purposes in some other manner. Furthermore, the present invention is not limited to a spiral belt refrigeration apparatus and would have application to other types of refrigeration apparatus.

While the present invention has been described with reference to a preferred embodiment, as will occur in the skill in the art, numerous changes, additions and omissions may be made without departing from the spirit and scope of the present invention.

I claim:

1. A method of refrigerating a heat load, said method comprising the steps of:

a) indirectly exchanging heat between said heat load and a cryogenic refrigerant so that said heat load cools;

b) indirectly exchanging further heat between said heat load and a mechanical refrigerant;

c) subjecting said mechanical refrigerant to a refrigeration cycle in which said mechanical refrigerant is compressed, cooled, condensed, expanded, and evaporated; and d) indirectly exchanging other heat between said cryogenic said cryogenic refrigerant being subjected to step d) after the indirect heat exchange of step a);

said mechanical refrigerant being subject to step d) between the condensation and expansion of step c).

2. The method of claim 1, wherein step a) is conducted before step b).

3. The method of claim 2, wherein step a) is conducted so that said cryogenic refrigerant changes state from a liquid to a superheated vapor.

4. The method of claim 2, wherein said indirect heat exchange between said cryogenic refrigerant and said mechanical refrigerant is also conducted so that said cryogenic refrigerant has a discharge temperature from said indirect heat exchange of step c)at about a condenser discharge temperature of said mechanical refrigerant after condensation of said mechanical refrigerant.

5. A refrigeration apparatus comprising:

a cryogenic heat exchanger for indirectly exchanging heat between a cryogenic refrigerant and a heat load;

a mechanical refrigeration circuit having at least, a compressor for compressing a mechanical refrigerant, a condenser for condensing said mechanical refrigerant, a valve for expanding said mechanical refrigerant, and an evaporator for exchanging further heat between said heat load and said mechanical refrigerant; and a heat exchanger linking said cryogenic heat exchanger and said mechanical refrigeration circuit so that other heat is exchanged between said mechanical refrigerant and said cryogenic refrigerant after said cryogenic refrigerant has exchanged heat with said heat load;

said heat exchanger interposed between said condenser and said evaporator.

6. The refrigeration apparatus of claim 5, wherein said cryogenic heat exchanger and said evaporator arranged such that said heat is exchanged between said cryogenic refrigerant and said heat load before said further heat is exchanged between said heat load and said mechanical refrigerant.

7. The refrigeration apparatus of claim 5, wherein said cryogenic heat exchanger has countercurrent passes.

* * * * *